US009366987B2

(12) United States Patent
Suzuki

(10) Patent No.: US 9,366,987 B2
(45) Date of Patent: Jun. 14, 2016

(54) DEVELOPING ROLLER, AND IMAGE FORMING APPARATUS

(71) Applicant: SUMITOMO RUBBER INDUSTRIES, LTD., Kobe-shi, Hyogo (JP)

(72) Inventor: Daijiro Suzuki, Kobe (JP)

(73) Assignee: SUMITOMO RUBBER INDUSTRIES, LTD., Kobe-Shi (JP)

( * ) Notice: Subject to any disclaimer, the term of this patent is extended or adjusted under 35 U.S.C. 154(b) by 0 days.

(21) Appl. No.: 14/928,787

(22) Filed: Oct. 30, 2015

(65) Prior Publication Data

US 2016/0139534 A1 May 19, 2016

(30) Foreign Application Priority Data

Nov. 17, 2014 (JP) ..... 2014-232633

(51) Int. Cl.
*G03G 15/08* (2006.01)

(52) U.S. Cl.
CPC ..... *G03G 15/0808* (2013.01)

(58) Field of Classification Search
CPC ..... G03G 15/0808; G03G 15/0818
See application file for complete search history.

(56) References Cited

U.S. PATENT DOCUMENTS 6,397,032 B1 * 5/2002 Sakaizawa ..... G03G 15/0818 399/286
6,484,007 B1 * 11/2002 Ozeki ..... G03G 15/0818 399/286
2004/0223792 A1 * 11/2004 Aoki ..... G03G 15/0808 399/281
2005/0191095 A1 * 9/2005 Aoki ..... G03G 15/0844 399/281
2007/0243984 A1 10/2007 Mizumoto
2014/0103262 A1 4/2014 Marui et al.
2015/0177651 A1 * 6/2015 Fujishima ..... G03G 15/09 399/276

FOREIGN PATENT DOCUMENTS

JP 5188681 B2 4/2013
JP 2014-80456 A 5/2014

* cited by examiner

*Primary Examiner* — David Gray
*Assistant Examiner* — Sevan A Aydin
(74) *Attorney, Agent, or Firm* — Birch, Stewart, Kolasch & Birch, LLP

(57) ABSTRACT

A developing roller is provided, which is capable of controlling a solid black density and a dot density at higher levels than currently available levels. An image forming apparatus employing the developing roller is also provided. The developing roller (1) includes a tubular base layer (4) of an elastic material, and a surface layer (6) of an elastic material provided on an outer peripheral surface (5) of the base layer (4), wherein the thickness $d_1$ (mm) of the surface layer, the roller resistance R' (log Ω as measured with an application voltage of 10 V) of the base layer, and the roller resistance R (log Ω as measured with an application voltage of 100 V) of a stack including the base layer and the surface layer satisfy the following expressions (1) to (3):

$$1.0 \leq R - R' \quad (1)$$

$$0.1 \leq d_1 \leq 2 \quad (2)$$

$$7.5 \leq R \leq 8.5 \quad (3)$$

The image forming apparatus incorporates the developing roller.

12 Claims, 2 Drawing Sheets

DEVELOPING ROLLER, AND IMAGE FORMING APPARATUS

TECHNICAL FIELD

The present invention relates to a developing roller to be incorporated in an electrophotographic image forming apparatus for use, and to an image forming apparatus employing the developing roller.

BACKGROUND ART

In an electrophotographic image forming apparatus such as a laser printer, an electrostatic copying machine, a plain paper facsimile machine or a printer-copier-facsimile multifunction machine, an image is generally formed on a surface of a sheet such as a paper sheet or a plastic film through the following process steps.

First, a surface of a photoreceptor body having photoelectric conductivity is evenly electrically charged and, in this state, exposed to light, whereby an electrostatic latent image corresponding to an image to be formed on the sheet is formed on the surface of the photoreceptor body (charging step and exposing step).

Then, toner (minute color particles) preliminarily electrically charged at a predetermined potential is brought into contact with the surface of the photoreceptor body. Thus, the toner selectively adheres to the surface of the photoreceptor body according to the potential pattern of the electrostatic latent image, whereby the electrostatic latent image is developed into a toner image (developing step).

Subsequently, the toner image is transferred onto the surface of the sheet (transfer step), and fixed to the surface of the sheet (fixing step). Thus, the image is formed on the surface of the sheet.

Further, a part of the toner remaining on the surface of the photoreceptor body after the transfer of the toner image is removed, for example, by a cleaning blade or the like (cleaning step). Thus, the photoreceptor body is ready for the next image formation.

In the developing step out of the aforementioned process steps, a developing roller is used for developing the electrostatic latent image formed on the surface of the photoreceptor body into the toner image.

A known developing roller is produced, for example, by blending an ion conductive rubber such as an epichlorohydrin rubber with a diene rubber such as a styrene butadiene rubber (SBR) or a chloroprene rubber (CR) as a rubber component to prepare an ion conductive rubber composition, forming the rubber composition into a tubular body, crosslinking the rubber component of the tubular body, and further forming an oxide film on an outer peripheral surface of the tubular body by UV irradiation (Patent Document 1 and the like).

CITATION LIST

Patent Document

Patent Document 1: JP2014-80456A
Patent Document 2: JP5188681

SUMMARY OF THE INVENTION

Problem to be Solved by the Invention

Known bases for image evaluation of an image forming apparatus include the density of an entirely black image called "solid black image" (solid black density), and the density of an image which contains round dots arranged at a pitch of about 80 μm in a square matrix array (dot density).

The solid black density is an important factor for improvement of the contrast of the entire formed image, while the dot density is an important factor for improvement of the reproducibility of a thin line image.

However, these two image densities are reciprocal to each other with respect to a roller resistance. That is, the solid black density tends to increase and the dot density tends to decrease, as the roller resistance decreases. The solid black density tends to decrease and the dot density tends to increase, as the roller resistance increases.

With the conventional developing roller, therefore, it is difficult to control the solid black density and the dot density in proper ranges. Accordingly, the solid black density and the dot density are not controlled at the highest possible levels but are generally balanced at higher levels.

It is an object of the present invention to provide a developing roller which is capable of controlling the solid black density and the dot density at higher levels than currently available levels, and to provide an image forming apparatus employing the developing roller.

Solution to Problem

According to the present invention, there is provided a developing roller, which includes a tubular base layer of an elastic material, and a surface layer of an elastic material provided on an outer peripheral surface of the base layer, wherein the thickness $d_1$ (mm) of the surface layer, the roller resistance R' (log Ω as measured with an application voltage of 10 V) of the base layer, and the roller resistance R (log Ω as measured with an application voltage of 100 V) of a stack including the base layer and the surface layer satisfy the following expressions (1) to (3):

$$1.0 \leq R - R' \quad (1)$$

$$0.1 \leq d_1 \leq 2 \quad (2)$$

$$7.5 \leq R \leq 8.5 \quad (3)$$

According to the present invention, there is also provided an image forming apparatus which includes the inventive developing roller described above.

Effects of the Invention

According to the present invention, the developing roller is configured so that the surface layer of the elastic material is provided on the outer peripheral surface of the base layer of the elastic material. Further, the thickness $d_1$ (mm) of the surface layer is set in a range satisfying the expression (2), and the roller resistance R' (log Ω as measured with an application voltage of 10 V) of the base layer and the roller resistance R (log Ω as measured with an application voltage of 100 V) of the overall developing roller are respectively set in ranges satisfying the above expressions (1) and (3). Thus, the developing roller and the image forming apparatus employing the developing roller are capable of controlling the solid black density and the dot density at higher levels than the currently available levels.

EMBODIMENTS OF THE INVENTION

Figure 1A:
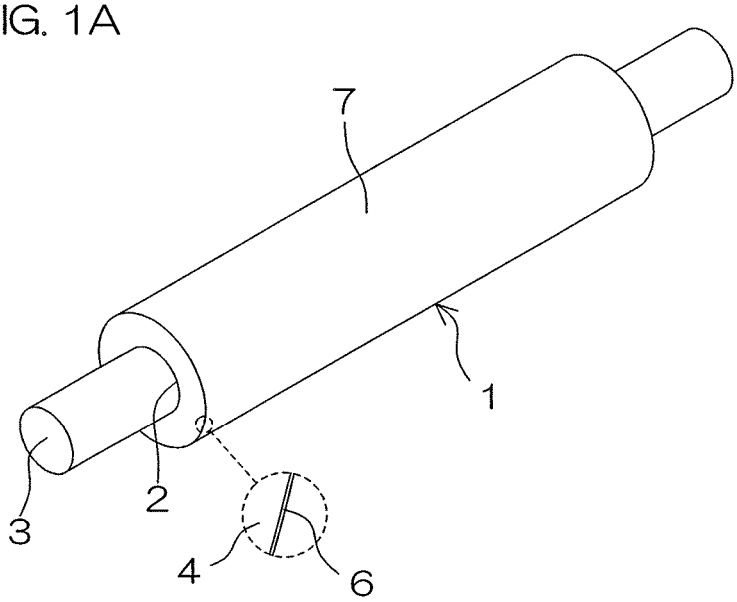
FIGS. 1A and 1B are a perspective view and an end view, respectively, of an exemplary developing roller according to an embodiment of the present invention.
Figure 1B:
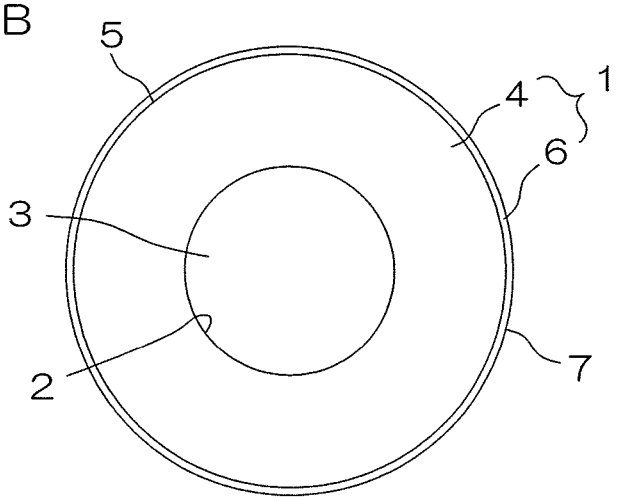

Referring to FIGS. 1A and 1B, the developing roller 1 according to this embodiment includes a tubular base layer 4 of an elastic material having a center through-hole 2, a shaft 3 inserted through and fixed to the center through-hole 2, and a surface layer 6 of an elastic material provided on an outer peripheral surface 5 of the base layer 4.

The shaft 3 is a unitary member made of a metal such as aluminum, an aluminum alloy or a stainless steel.

The shaft 3 is electrically connected to and mechanically fixed to the base layer 4, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the base layer 4. Thus, the shaft 3 and the base layer 4 are unitarily rotatable.

In the present invention, the thickness $d_1$ (mm) of the surface layer 6, the roller resistance R' (log Ω as measured with an application voltage of 10 V) of the base layer 4, and the roller resistance R (log Ω as measured with an application voltage of 100 V) of a stack including the base layer 4 and the surface layer 6, i.e., the entire developing roller 1, should satisfy the following expressions (1) to (3):

$$1.0 \leq R - R' \quad (1)$$

$$0.1 \leq d_1 \leq 2 \quad (2)$$

$$7.5 \leq R \leq 8.5 \quad (3)$$

The inventor of the present invention calculated the amount of toner transferred from the developing roller to a photoreceptor body by an electric field analysis and, as a result, confirmed that both the solid black density and the dot density are improved by providing a dielectric surface layer on the outer peripheral surface of the developing roller. Incidentally, a dielectric material is generally an electrically insulative material having a very high electric resistance. Where the dielectric material is used for the surface layer of the developing roller, therefore, the roller resistance of the entire developing roller is disadvantageously increased (Patent Document 2 and the like).

The inventor conducted studies to determine an approximate range of the electric resistance of the surface layer serving as the dielectric layer. As a result, the inventor found that, where the surface layer 6 is made of an ordinary elastic material having a relative dielectric constant of about 10 to about 20, for example, a difference between the roller resistance R (log Ω as measured with an application voltage of 100 V) of the overall developing roller 1 and the roller resistance R' (log Ω as measured with an application voltage of 10 V) of the base layer 4 (the difference corresponding to the roller resistance of the surface layer 6) should satisfy the above expression (1) and the thickness $d_1$ (mm) should satisfy the above expression (2) to impart the surface layer 6 with a dielectric property.

If the difference R−R' is less than the range defined by the above expression (1) or the thickness $d_1$ (mm) is less than the range defined by the above expression (2), the roller resistance R (log Ω as measured with an application voltage of 100 V) of the overall developing roller 1 is less than the range defined by the above expression (3), resulting in reduction in dot density.

If the thickness $d_1$ (mm) is greater than the range defined by the above expression (2), on the other hand, the roller resistance R (log Ω as measured with an application voltage of 100 V) of the overall developing roller 1 is greater than the range defined by the above expression (3), resulting in reduction in solid black density.

Where the difference R−R' satisfies the above expression (I) and the thickness $d_1$ (mm) satisfies the above expression (2), it is possible to impart the surface layer 6 with the dielectric property to improve the solid black density and the dot density to higher levels than currently available levels, while controlling the roller resistance R (log Ω as measured with an application voltage of 100 V) of the overall developing roller 1 in the range defined by the expression (3) to maintain the electrical conductivity of the developing roller 1 at a proper level.

The upper limit of the difference R−R' is not particularly limited. However, it is impossible to form a highly electrically conductive base layer 4 having a roller resistance R' (log Ω as measured with an application voltage of 10 V) of less than 3, for example, by adding general purpose carbon or graphite in an amount that can impart the base layer 4 with a practical hardness. In practice, therefore, the difference R−R' is preferably not greater than about 5.5.

<<Base Layer 4>>

The base layer 4 is made of any of various elastic materials imparted with an electrical conductivity that permits the overall developing roller 1 including the base layer 4 and the surface layer 6 to have a roller resistance R (log Ω as measured with an application voltage of 100 V) falling within the range defined by the expression (3).

Particularly, the base layer 4 is preferably formed from a rubber composition imparted with electron conductivity by blending a less expensive electron conductive agent (electrically conductive filler) such as carbon or graphite rather than an expensive ion conductive rubber with a rubber component such as a diene rubber.

In order to impart the overall, developing roller 1 with a roller resistance R (log Ω as measured with an application voltage of 100 V) falling within the range defined by the expression (3), the roller resistance R' (log Ω as measured with an application voltage of 10 V) of the base layer 4 is preferably set lower than the aforementioned roller resistance R (log Ω as measured with an application voltage of 100 V), and particularly preferably satisfies the following expression (4):

$$R' \leq 7.0 \quad (4)$$

Thus, the roller resistance R (Ω) of the overall developing roller including the base layer 4 and the surface layer 6 can be controlled within the range defined by the expression (3).

Variations in resistance are liable to be increased by uneven dispersion of the electron conductive agent and the like. In the present invention, however, the roller resistance R' (log Ω as measured with an application voltage of 10 V) of the base layer 4 is set lower than the roller resistance R (log Ω as measured with an application voltage of 100 V) of the overall developing roller 1 as described above, so that the variations in the resistance of the base layer 4 hardly influences the roller resistance R (Ω) of the developing roller 1. Therefore, the developing roller 1 can be advantageously produced at lower costs by using the less expensive electron conductive agent for the base layer 4.

The lower limit of the roller resistance R' (log Ω as measured with an application voltage of 10 V) of the base layer 4 is not particularly limited, but preferably not less than 4.0. If the roller resistance R' of the base layer 4 is to be reduced to lower than this range, the proportion of the carbon or the graphite to be blended should be increased. This may reduce the elasticity, the flexibility or the strength of the base layer 4.

Since the base layer 4 is covered with the surface layer 6 and, therefore, is not brought into direct contact with a photoreceptor body or toner, process aids such as an oil, a plasticizer or a fatty acid can be blended in a greater amount with the rubber composition to improve the flexibility of the base layer 4 and hence the overall developing roller 1.

By thus imparting the developing roller 1 with the flexibility, the image quality can be improved. In addition, a stress to be applied to the toner in a developing step is reduced, so that the service life of the toner can be increased.

<Diene Rubber>

The diene rubber is, for example, at least one selected from the group consisting of a styrene butadiene rubber (SBR), a chloroprene rubber (CR), an acrylonitrile butadiene rubber (NBR) and a butadiene rubber (BR).

(SBR)

Usable as the SBR are various SBRs synthesized by copolymerizing styrene and 1,3-butadiene by an emulsion polymerization method, a solution polymerization method and other various polymerization methods. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable.

These SBRs may be used alone or in combination.

(CR)

The CR is synthesized, for example, by polymerizing chloroprene by an emulsion polymerization method. The CR is classified in a sulfur modification type or a non-sulfur-modification type depending on the type of a molecular weight adjusting agent to be used for the emulsion polymerization. Either type of CRs is usable in the present invention.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of these types of CRs is usable. Particularly, CRs of the non-sulfur-modification type and the lower crystallization speed type are preferably used alone or in combination.

Further, a rubber of a copolymer of chloroprene and other comonomer may be used as the CR.

Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Either type of NBRs is usable.

These NBRs may be used alone or in combination.

(BR)

Usable as the BR are various crosslinkable BRs.

Particularly, a higher cis-content BR having a cis-1,4 bond content of not less than 95% and having excellent lower-temperature characteristic properties and a lower hardness and hence a higher flexibility at a lower temperature at a lower humidity is preferred.

The BRs include those of an oil-extension type having flexibility controlled by addition of an extension oil, and those of a non-oil-extension type containing no extension oil. Either type of BRs is usable.

These BRs may be used alone or in combination.

<Electron Conductive Agent>

Preferred examples of the electron conductive agent include carbon and graphite, particularly, each having an iodine adsorption amount of not less than 80 mg/g and an oil adsorption amount of not less than 60 ml/100 g.

The iodine adsorption amount and the oil adsorption amount of the carbon and the graphite are limited to the aforementioned ranges for the following reasons:

If the carbon or the graphite has an iodine adsorption amount of less than 80 mg/g or an oil adsorption amount of less than 60 ml/100 g, the effect of reducing the roller resistance R' (log Ω as measured with an application voltage of 10 V) of the base layer 4 is insufficient, making it impossible to reduce the roller resistance R' to the range defined by the above expression (4). To reduce the roller resistance R' to the aforementioned range, the proportion of the carbon or the graphite to be blended should be increased. This may reduce the elasticity, the flexibility or the strength of the base layer 4.

The proportion of the carbon or the graphite to be blended is preferably not less than 30 parts by mass based on 100 parts by mass of the overall rubber component.

If the proportion of the carbon or the graphite is less than the aforementioned range, the resistance of the base layer 4 is liable to become excessively high. Therefore, the roller resistance R of the overall developing roller 1 is liable to be increased to higher than the upper limit of the range defined by the expression (3), thereby reducing the solid black density.

If the proportion of the carbon or the graphite is excessively great, the hardness of the base layer 4 and hence the hardness of the developing roller 1 are liable to be increased even with addition of a great amount of an oil, thereby reducing the image quality. In addition, the stress to be applied to the toner in a developing step is liable to be increased, thereby reducing the service life of the toner.

The proportion of the carbon or the graphite to be blended is preferably not greater than 60 parts by mass based on 100 parts by mass of the overall rubber component.

<Processing Aid>

Examples of the processing aid include oils such as process oils, plasticizers such as dibutyl phthalate (DBP), dioctyl phthalate (DOP) and tricresyl phosphate, waxes such as polar waxes, and fatty acids such as stearic acid, which may be used alone or in combination.

The proportion of the processing aid to be blended is preferably not less than 40 parts by mass and not greater than 60 parts by mass based on 100 parts by mass of the overall rubber component in order to impart the base layer 4 with proper flexibility.

<Crosslinking Component>

The rubber composition contains a crosslinking component for crosslinking the rubber component. The crosslinking component includes a crosslinking agent, an accelerating agent and an acceleration assisting agent.

Examples of the crosslinking agent include a sulfur crosslinking agent, a thiourea crosslinking agent, a triazine derivative crosslinking agent, a peroxide crosslinking agent and monomers, which may be used alone or in combination.

Examples of the sulfur crosslinking agent include sulfur such as sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is a number of 1 to 10), which may be used alone or in combination.

Examples of the peroxide crosslinking agent include benzoyl peroxide and the like.

Preferably used as the crosslinking agent is sulfur.

The proportion of the sulfur to be blended is preferably not less than 0.2 parts by mass and not greater than 3 parts by mass, particularly preferably not less than 0.5 parts by mass and not greater than 2 parts by mass, based on 100 parts by mass of the overall rubber component.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used alone or in combination.

Different types of accelerating agents have different functions and, therefore, are preferably used in combination.

The proportion of each of the accelerating agents to be blended may be properly determined depending on the type of the accelerating agent, but is typically not less than 0.1 part by mass and not greater than 5 parts by mass, particularly preferably not less than 0.2 parts by mass and not greater than 2 parts by mass, based on 100 parts by mass of the overall rubber component.

Examples of the acceleration assisting agent include: metal compounds such as zinc white; fatty acids such as stearic acid, oleic acid and cotton seed fatty acids; and other conventionally known acceleration assisting agents, which may be used alone or in combination.

The proportion of each of the acceleration assisting agents to be blended is preferably not less than 0.1 part by mass and not greater than 7 parts by mass, particularly preferably not less than 0.5 parts by mass and not greater than 5 parts by mass, based on 100 parts by mass of the overall rubber component.

<Other Ingredients>

As required, various additives may be added to the rubber composition. Examples of the additives include an acid accepting agent, a degradation preventing agent, a filler, an anti-scorching agent, a lubricant, a pigment, an anti-static agent, a flame retarder, a neutralizing agent, a nucleating agent and a co-crosslinking agent.

In the presence of the acid accepting agent, chlorine-containing gases generated from the CR during the crosslinking of the rubber component are prevented from remaining in the base layer 4. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 4 parts by mass, based on 100 parts by mass of the overall rubber component.

Examples of the degradation preventing agent include various anti-aging agents and anti-oxidants.

The anti-oxidants serve to reduce the environmental dependence of the roller resistance of the developing roller 1 and to suppress the increase in roller resistance during continuous energization of the developing roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Examples of the filler include zinc oxide, silica, reinforcement carbon black, clay, talc, calcium carbonate, magnesium carbonate and aluminum hydroxide, which may be used alone or in combination.

The mechanical strength and the like of the base layer 4 can be improved by blending the filler.

The proportion of the filler to be blended is preferably not less than 5 parts by mass and not greater than 25 parts by mass, particularly preferably not greater than 20 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth) acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

<Rubber Composition>

The rubber composition containing the ingredients described above can be prepared in a conventional manner. First, the rubber component is simply kneaded, and additives other than the crosslinking component are added to and kneaded with the rubber component. Then, the crosslinking component is finally added to and further kneaded with the resulting mixture. Thus, the rubber composition is provided. A kneader, a Banbury mixer, an extruder or the like, for example, is usable for the kneading.

<Formation of Base Layer 4>

For the formation of the base layer 4, the aforementioned rubber composition is first extruded into a tubular body by means of an extruder. Then, the tubular body is cut to a predetermined length, and crosslinked in a vulcanization can by heat and pressure.

In turn, the tubular body thus crosslinked is heated in an oven or the like for secondary crosslinking, then cooled, and polished to a predetermined outer diameter. Thus, the base layer 4 is formed.

In order to impart the base layer 4 with a roller resistance R' (log Ω as measured with an application voltage of 10 V) falling within the range defined by the expression (4), the type and the proportion of the carbon or the graphite to be blended are changed as described above.

The hardness, the compression set and the like of the base layer 4 can be each adjusted to a desired level. The adjustment of the hardness, the compression set and the like of the base layer 4 may be achieved by properly determining the type and the proportion of the carbon or the graphite or the type and the proportion of the processing aid as well as the type and the proportion of the rubber for the rubber component, the types and the proportions of the compounds for the crosslinking component, and the types and the proportions of the filler and other ingredients.

The thickness of the base layer 4 may be properly determined according to the construction and the dimensions of an image forming apparatus in which the developing roller is to be incorporated.

The base layer 4 preferably has a nonporous single-layer structure for simplification of the structure thereof and for improvement of the durability thereof.

<<Surface Layer 6>>

The surface layer 6 may be made of any elastic material that makes it possible to satisfy all the expressions (1) to (3) described above.

However, the surface layer is neither a coating film nor a tubular cover of a thermoplastic material, but is preferably formed from a rubber composition containing a diene rubber as a rubber component.

The surface layer formed from the rubber composition has a lower hardness and a smaller compression set than the coating film and the tubular cover described above. Even if the surface layer has a relatively great thickness $d_1$ (mm) within the aforementioned range, therefore, reduction in the flexibility of the overall developing roller 1 can be suppressed. Advantageously, the developing roller 1 is less liable to suffer from a compression mark, even if the developing roller 1 is stored for a long period of time with a part thereof kept in contact with the photoreceptor body.

Particularly, the rubber composition is preferably an ion conductive rubber composition, particularly containing an epichlorohydrin rubber and the diene rubber as the rubber component, in order to stabilize the roller resistance R (log Ω as measured with an application voltage of 100 V) of the overall developing roller 1.

<Epichlorohydrin Rubber>

Examples of the epichlorohydrin rubber for the rubber component include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used either alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the resistance of the surface layer 6.

If the ethylene oxide content is less than the aforementioned range, however, it will be impossible to sufficiently provide this function and hence to sufficiently reduce the resistance.

If the ethylene oxide content is greater than the aforementioned range, on the other hand, ethylene oxide is liable to be crystallized, whereby the segment motion of molecular chains is hindered to adversely increase the resistance. Further, the surface layer 6 is liable to have a higher hardness after the crosslinking, and the rubber composition is liable to have a higher viscosity when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the resistance of the surface layer 6.

However, if the allyl glycidyl ether content is less than the aforementioned range, it will be impossible to provide this function and hence to sufficiently reduce the resistance.

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered. This may adversely increase the resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The proportion of the epichlorohydrin rubber to be blended is preferably not less than 10 parts by mass and not greater than 80 parts by mass, particularly preferably not greater than 70 parts by mass, based on 100 parts by mass of the overall rubber component.

<Diene Rubber>

The diene rubber is at least one selected from the group consisting of a styrene butadiene rubber (SBR), a chloroprene rubber (CR), an acrylonitrile butadiene rubber (NBR) and a butadiene rubber (BR), for example.

Particularly, the NBR and/or the CR which are excellent in oil resistance are preferably used together.

As described above, the processing aid such as an oil is preferably added in a greater amount to the resin composition for the base layer 4 in order to improve the flexibility of the base layer 4 and hence the flexibility of the overall developing roller 1. The processing aid is liable to bleed from the base layer 4 and, when the developing roller 1 is stored for a long period of time with a part thereof kept in abutment against the photoreceptor body, for example, the photoreceptor body would be contaminated with the bleeding processing aid.

In the present invention, however, the surface layer 4 formed from the rubber composition containing the NBR and/or the CR which are excellent in oil resistance serves as a barrier to suppress the bleeding of the processing aid and the contamination of the photoreceptor body due to the bleeding.

The details of the diene rubbers are as described previously.

<Crosslinking Component>

The rubber composition contains a crosslinking component for crosslinking the rubber component. The crosslinking component includes a crosslinking agent, an accelerating agent and an acceleration assisting agent. The details of the crosslinking component are as described previously.

Of the aforementioned crosslinking agents, the sulfur and the thiourea crosslinking agent are preferably used together.

Where the sulfur and the thiourea crosslinking agent are used together, the proportion of the sulfur to be blended is preferably not less than 0.2 parts by mass and not greater than 3 parts by mass, particularly preferably not less than 0.5 parts by mass and not greater than 2 parts by mass, based on 100 parts by mass of the overall rubber component.

The proportion of the thiourea crosslinking agent to be blended is preferably not less than 0.2 parts by mass and not greater than 3 parts by mass, particularly preferably not less than 0.5 parts by mass and not greater than 1 part by mass, based on 100 parts by mass of the overall rubber component.

The proportions of the accelerating agent and the acceleration assisting agent to be blended preferably fall within the respective ranges described above.

<Other Ingredients>

As required, various additives may be added to the rubber composition. Examples of the additives include an acid accepting agent, a plasticizer, a processing aid, a degradation preventing agent, a filler, an anti-scorching agent, a lubricant, a pigment, an anti-static agent, a flame retarder, a neutralizing agent, a nucleating agent and a co-crosslinking agent. The details of these additives and the proportions of the additives are as described previously.

The surface layer 6 may be imparted with electron conductivity by adding an electron conductive agent (electrically conductive filler) such as electrically conductive carbon black as the filler to the rubber composition.

Examples of the electrically conductive carbon black include DENKA BLACK (registered trade name) available from Denki Kagaku Kogyo K.K., KETJEN BLACK (registered trade name) EC300J available from Lion Corporation, which may be used alone or in combination.

The proportion of the electrically conductive carbon black to be blended is preferably not less than 1 part by mass and not greater than 10 parts by mass based on 100 parts by mass of the overall rubber component.

<Rubber Composition>

The rubber composition containing the ingredients described above can be prepared in a conventional manner. First, the rubbers for the rubber component are blended in predetermined proportions, and the resulting blend is simply kneaded. In turn, additives other than the crosslinking component are added to and kneaded with the rubber component. Then, the crosslinking component is finally added to and further kneaded with the resulting mixture. Thus, the rubber composition is provided. A kneader, a Banbury mixer, an extruder or the like, for example, is usable for the kneading.

<Formation of Surface Layer 6>

To provide the surface layer 6 on the outer peripheral surface 5 of the base layer 4, the aforementioned rubber composition is formed into a sheet.

The sheet is wound around the outer peripheral surface 5 of the base layer 4. The resulting product is put in a press mold, and press-molded. Thus, the sheet is crosslinked to be combined with the base layer 4. Then, the combined sheet is cooled, and polished so as to have a predetermined thickness $d_1$ (mm). Thus, the surface layer 6 is formed.

A difference between the roller resistance R (log Ω as measured with an application voltage of 100 V) of the overall developing roller 1 and the roller resistance R' (log Ω as measured with an application voltage of 10 V) of the base layer 4 (the difference corresponding to the roller resistance of the surface layer 6) may be controlled to fall within the range defined by the expression (1) by changing the type and the proportion of the ion conductive rubber such as the epichlorohydrin rubber described above and by changing the type and the proportion of the electrically conductive carbon black if blending.

Further, the hardness and the compression set of the surface layer 6 may be each adjusted to a desired level. The adjustment of the hardness and the compression set of the surface layer 6 may be achieved by properly determining the types and the proportions of the rubbers for the rubber component, the types and the proportions of the compounds for the crosslinking component, and the types and the proportions of the filler and other ingredients.

The surface layer 6 preferably has a nonporous single-layer structure for simplification of the structure thereof and for improvement of the durability thereof.

<<Roller Resistance Measuring Method>>

Figure 2:
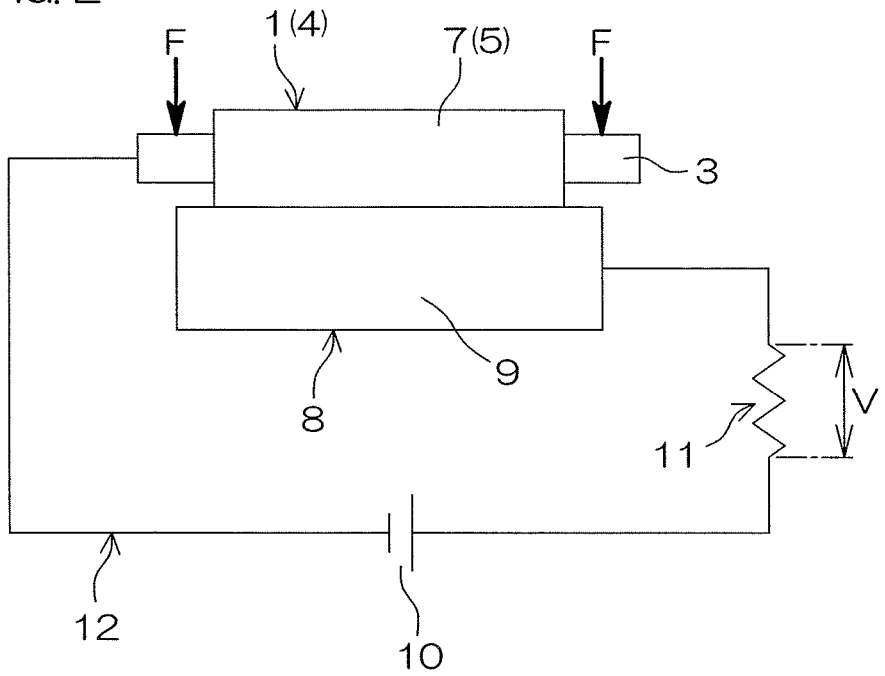
FIG. 2 is a diagram for explaining how to measure the roller resistance of the developing roller.

FIG. 2 is a diagram for explaining how to measure the roller resistance R of the overall developing roller 1 and the roller resistance R' of the base layer 4.

Referring to FIGS. 1 and 2, the roller resistance R of the overall developing roller 1 and the roller resistance R' of the base layer 4 are measured with an application voltage of 100 V and with an application voltage of 10 V, respectively, in an ordinary temperature and ordinary humidity environment at a temperature of 23° C. at a relative humidity of 55% by the following method in the present invention.

More specifically, an aluminum drum 8 rotatable at a constant rotation speed is prepared, and an outer peripheral surface 7 of the developing roller 1 or the outer peripheral surface 5 of the base layer 4 before the formation of the surface layer 6 is brought into contact with an outer peripheral surface 9 of the aluminum drum 8 from above with the shaft 3 preliminarily inserted through and fixed to the base layer 4.

A DC power source 10 and a resistor 11 are connected in series between the shaft 3 and the aluminum drum 8 to provide a measurement circuit 12. The DC power source 10 is connected to the shaft 3 at its negative terminal, and connected to the resistor 11 at its positive terminal. The resistor 11 has a resistance $r_{11}$ of 100 Ω.

Subsequently, a load F of 500 g is applied to opposite end portions of the shaft 3 to bring the outer peripheral surface 7 of the developing roller 1 or the outer peripheral surface 5 of the base layer 4 into press contact with the aluminum drum 8 and, in this stare, a detection voltage V applied to the resistor 11 is measured 100 times in 4 seconds by applying an application voltage E of DC 100 V or 10 V from the DC power source 10 between the shaft 3 and the aluminum drum 8 while rotating the aluminum drum 8 (at a rotation speed of 30 rpm). Then, the detection voltages V thus measured are averaged.

The roller resistance r (Ω) of the developing roller 1 and the roller resistance r' (Ω) of the base layer 4 are each basically calculated from the following expression (1)' based on the average detection voltage V and the application voltage E (=100 V or 10 V):

$$r \text{ or } r' = r_{11} \times E/(V - r_{11}) \quad (1)'$$

However, the term $-r_{11}$ in the denominator of the expression (1)' is negligible, so that the roller resistance r (Ω) and the roller resistance r' (Ω) are each calculated from the following expression (1) in the present invention:

$$r \text{ or } r' = r \times E/V \quad (1)$$

The roller resistance R (log Ω as measured with an application voltage of 100 V) of the developing roller 1 and the roller resistance R' (log Ω as measured with an application voltage of 10 V) of the base layer 4 are respectively expressed as log values of r (Ω) and r' (Ω).

<<Image Forming Apparatus>>

An image forming apparatus according to the present invention has a feature that the inventive developing roller is incorporated therein.

Examples of the image forming apparatus according to the present invention include electrophotographic image forming apparatuses such as a laser printer, an electrostatic copying machine, a plain paper facsimile machine and a printer-copier-facsimile multifunction machine.

EXAMPLES

Base Layer i (Rubber Composition)

As a rubber component, an SBR (non-oil-extension type SBR JSR 1502 available from JSR Co., Ltd. and having a styrene content of 23.5%) was prepared.

While 100 parts by mass of the SBR was simply kneaded by means of a Banbury mixer, 50 parts by mass of carbon black (SHOWBLACK N219 available from Cabot Japan K.K.) having an iodine adsorption amount of 113 mg/g and an oil adsorption amount of 78 ml/100 g, 50 parts by mass of an aroma process oil (VivaTec 400, T-DAE available from H & R Corporation) and ingredients shown below in Table 1 except the crosslinking component were added to the rubber component. After the resulting mixture was further kneaded, the crosslinking component was added to and further kneaded with the mixture. Thus, a rubber composition for a base layer i was prepared.

TABLE 1

| Ingredients | Parts by mass |
|---|---|
| 5% Oil-containing sulfur | 1.20 |
| Accelerating agent MBTS | 0.20 |
| Accelerating agent TS | 0.50 |
| Zinc oxide type-2 | 5.00 |

The ingredients shown in Table 1 are as follows. The amounts (parts by mass) shown in Table 1 are based on 100 parts by mass of the overall rubber component. 5% Oil-containing sulfur: Crosslinking agent available from Tsurumi Chemical Industry Co., Ltd.

Accelerating agent MBTS: Di-2-benzothiazolyl disulfide, thiazole accelerating agent NOCCELER (registered trade name) DM-P available from Ouchi Shinko Chemical Industrial Co., Ltd.

Accelerating agent TS: Tetramethylthiuram monosulfide, thiuram accelerating agent SANCELER (registered trade name) TS available from Sanshin Chemical Industry Co., Ltd.

Zinc oxide Type-2: Acceleration assisting agent available from Sakai Chemical Industry Co., Ltd.

(Production of Base Layer i)

The rubber composition thus prepared was fed into an extruder, and extruded into a tubular body having an outer diameter of 20.0 mm and an inner diameter of 7.0 mm. Then, the tubular body was fitted around a temporary crosslinking shaft, and crosslinked in a vulcanization can at 160° C. for 1 hour.

Subsequently, the crosslinked tubular body was removed from the temporary shaft, then fitted around a shaft having an outer diameter of 7.5 mm and an outer peripheral surface to which an electrically conductive thermosetting adhesive agent was applied, and heated in an oven at 160° C. Thus, the tubular body was bonded to the shaft. In turn, opposite end portions of the tubular body were cut, and the outer peripheral surface of the resulting tubular body was polished by a traverse polishing method by means of a cylindrical polishing machine. Then, the outer peripheral surface was mirror-polished as having an outer diameter of 15.00 mm (with a tolerance of 0.05), and rinsed with water. Thus, a base layer i unified with the shaft was produced.

The roller resistance R' (log Ω) of the base layer i thus produced was 6.1 as measured with an application voltage of 10 V by the aforementioned measuring method.

Base Layer ii

A rubber composition for a base layer ii was prepared in substantially the same manner as the rubber composition for the base layer i, except that the proportion of the carbon black (SHOWBLACK N219 available from Cabot Japan K.K.) was 40 parts by mass based on 100 parts by mass of the SBR. Then, a base layer ii unified with a shaft was produced by using the rubber composition thus prepared.

The roller resistance R' (log Ω) of the base layer ii thus produced was 7.0 as measured with an application voltage of 10 V by the aforementioned measuring method.

Base Layer iii

A rubber composition for a base layer iii was prepared in substantially the same manner as the rubber composition for the base layer i, except that carbon black (SHOWBLACK N220 available from Cabot Japan K.K.) having an iodine adsorption amount of 119 mg/g and an oil adsorption amount of 115 ml/100 g was blended in a proportion of 50 parts by mass based on 100 parts by mass of the SBR. Then, a base layer iii unified with a shaft was produced by using the rubber composition thus prepared.

The roller resistance R' (log Ω) of the base layer iii thus produced was 5.5 as measured with an application voltage of 10 V by the aforementioned measuring method.

Base Layer iv

A rubber composition for a base layer iv was prepared in substantially the same manner as the rubber composition for the base layer i, except that the proportion of the carbon black (SHOWBLACK N219 available from Cabot Japan K.K.) was 37 parts by mass based on 100 parts by mass of the SBR. Then, a base layer iv unified with a shaft was produced by using the rubber composition thus prepared.

The roller resistance R' (log Ω) of the base layer iv thus produced was 7.2 as measured with an application voltage of 10 V by the aforementioned measuring method.

<<Surface Layer I>>

(Rubber Composition)

A rubber component was prepared by blending 5 parts by mass of a GECO (EPION (registered trade name) 301L available from Daiso Co., Ltd. and having a molar ratio of EO/EP/AGE=73/23/4), 10 parts by mass of a CR (SHOPRENE (registered trade name) WRT available from Showa Denko K.K.) and 85 parts by mass of an NBR (lower acrylonitrile content NBR JSR N250 SL available from JSR Co., Ltd. and having an acrylonitrile content of 20%).

While 100 parts by mass of the rubber component was simply kneaded by means of a Banbury mixer, ingredients shown below in Table 2 except the crosslinking component were added to the rubber component. After the resulting mixture was further kneaded, the crosslinking component was added to and further kneaded with the mixture. Thus, a rubber composition for a surface layer I was prepared.

TABLE 2

| Ingredients | Parts by mass |
|---|---|
| 5% Oil-containing sulfur | 1.20 |
| Thiourea crosslinking agent | 0.50 |
| Accelerating agent MBTS | 0.20 |
| Accelerating agent TS | 0.50 |
| Accelerating agent DT | 0.43 |
| Zinc oxide type-2 | 5.00 |
| Carbon black | 5.00 |
| Acid accepting agent | 3.00 |

The 5% oil-containing sulfur, the accelerating agent MBTS, the accelerating agent TS and the zinc oxide type-2 shown in Table 2 were the same as those shown in Table 1. The other ingredients shown in Table 2 are as follows. The amounts (parts by mass) shown in Table 2 are based on 100 parts by mass of the overall rubber component.

Thiourea crosslinking agent: Ethylene thiourea (2-mercaptoimidazoline) ACCEL (registered trade name) 22-S available from Kawaguchi Chemical Industry Co., Ltd.

Accelerating agent DT: 1,3-di-o-tolylguanidine, guanidine accelerating agent SANCELER DT available from Sanshin Chemical Industry Co., Ltd.

Carbon black: Reinforcement carbon black #15 (FT) available from Asahi Carbon Co., Ltd.

Acid accepting agent: Hydrotalcites DHT-4A (registered trade name) 2 available from Kyowa Chemical Industry Co., Ltd.

(Formation of Surface Layer I)

The rubber composition thus prepared was formed into a sheet, which was in turn wound around an outer peripheral surface of a base layer previously produced. The resulting product was put in a ϕ20 press mold, and press-molded at 160° C. for 1 hour. Thus, the rubber component was crosslinked, and the sheet was combined with the base layer. Further, the combined sheet was cooled, and polished to a thickness $d_1$ (mm) shown in Tables 3 and 4. Thus, the surface layer I was formed for production of a developing roller.

<<Surface Layer II>>

A rubber composition for a surface layer II was prepared in substantially the same manner as the rubber composition for the surface layer I, except that the proportions of the GECO and the NBR for the rubber component were 10 parts by mass and 80 parts by mass, respectively. Then, the surface layer II was formed from the rubber composition thus prepared to be combined with a base layer for production of a developing roller.

<<Surface Layer III>>

A rubber composition for a surface layer III was prepared in substantially the same manner as the rubber composition for the surface layer I, except that the proportions of the GECO and the NBR for the rubber component were 15 parts by mass and 75 parts by mass, respectively. Then, the surface layer III was formed from the rubber composition thus prepared to be combined with a base layer for production of a developing roller.

<<Surface Layer IV>>

A rubber composition for a surface layer IV was prepared in substantially the same manner as the rubber composition for the surface layer I, except that the proportions of the GECO and the NBR for the rubber component were 30 parts by mass and 60 parts by mass, respectively. Then, the surface layer IV was formed from the rubber composition thus prepared to be combined with a base layer for production of a developing roller.

Examples 1 to 8 and Comparative Examples 1 to 3

Developing rollers of Examples 1 to 8 and Comparative Examples 1 to 3 were produced by employing the base layers i to iv in combination with the surface layers I to IV as shown in Tables 3 and 4.

Comparative Examples 4 to 6

Developing rollers each having a single layer structure and an outer diameter of 16.00 mm (with a tolerance of 0.05) were produced by using the rubber compositions for the surface layer II (Comparative Example 4), the surface layer III (Comparative Example 5) and the surface layer IV (Comparative Example 6).

<<Measurement of Roller Resistance R>>

The roller resistance R (log Ω) of each of the developing rollers 1 thus produced was measured with an application voltage of 100 V by the aforementioned measuring method. Then, a difference R−R' between the roller resistance R (log Ω) thus measured and the roller resistance R' (log Ω measured with an application voltage of 10 V) was determined.

<<Actual Machine Test>>

<Solid Black Density>

The developing rollers produced in Examples and Comparative Examples were each incorporated in a laser printer having a printable A4-size sheet number of about 4000 (as determined and disclosed in conformity with the Japanese Industrial Standards JIS $X6932_{:2008}$). An image was sequentially formed at a printing percentage of 1% on 4000 plain paper sheets at a temperature of 23.5° C. at a relative humidity of 55% with the use of a positively-chargeable nonmagnetic single-component toner by the laser printer. Immediately thereafter, a single solid black image was formed on a sheet.

Image densities were measured at given five points on the thus formed black solid image by means of a reflective densitometer (a combination of a light table LP20 and TECHKON RT120 available from Techkon GmbH), and averaged. The average image density was defined as a solid black density. A developing roller providing a solid black density of not less than 1.30 was rated as acceptable.

<Dot Density>

Immediately after an image was sequentially formed at a printing percentage of 1% on 4000 plain paper sheets in the same manner as in the determination of the solid black density, a single dot image was formed on a sheet.

Image densities were measured at given five points on the thus formed dot image by means of the aforementioned reflective densitometer, and averaged. The average image density was defined as a dot density. A developing roller providing a dot density of not less than 0.030 was rated as acceptable.

The above results are shown in Tables 3 and 4.

TABLE 3

| | Example 1 | Example 2 | Example 3 | Example 4 | Example 5 | Example 6 | Example 7 | Example 8 |
|---|---|---|---|---|---|---|---|---|
| Base layer type | i | i | i | i | ii | iii | iii | iv |
| Surface layer type | II | III | II | III | III | III | III | II |
| R (log Ω) | 8.2 | 8.0 | 8.1 | 7.8 | 8.1 | 8.0 | 8.1 | 8.3 |
| R' (log Ω) | 6.1 | 6.1 | 6.2 | 6.2 | 7.0 | 5.5 | 5.4 | 7.2 |
| R − R' | 2.1 | 1.9 | 1.9 | 1.6 | 1.1 | 2.5 | 2.7 | 1.1 |
| $d_1$ (mm) | 1.0 | 1.0 | 0.5 | 0.5 | 1.0 | 1.0 | 2.0 | 1.0 |
| Solid black density | 1.37 | 1.39 | 1.38 | 1.37 | 1.39 | 1.38 | 1.37 | 1.32 |
| Dot density | 0.044 | 0.033 | 0.038 | 0.031 | 0.034 | 0.033 | 0.034 | 0.042 |

TABLE 4

| | Comparative Example 1 | Comparative Example 2 | Comparative Example 3 | Comparative Example 4 | Comparative Example 5 | Comparative Example 6 |
|---|---|---|---|---|---|---|
| Base layer type | i | i | ii | — | — | — |
| Surface layer type | I | IV | III | II | III | IV |
| R (log Ω) | 8.8 | 6.8 | 8.4 | 8.5 | 8.2 | 7.0 |
| R' (log Ω) | 6.1 | 6.1 | 6.9 | — | — | — |
| R − R' | 2.7 | 0.7 | 1.5 | — | — | — |
| $d_1$ (mm) | 1.5 | 1.5 | 3.0 | — | — | — |
| Solid black density | 1.29 | 1.37 | 1.28 | 1.17 | 1.21 | 1.37 |
| Dot density | 0.058 | 0.017 | 0.033 | 0.074 | 0.033 | 0.018 |

The results for Examples 1 to 8 and Comparative Examples 1 to 6 shown in Tables 3 and 4 indicate that, where the developing roller 1 has a layered structure including the base layer 4 and the surface layer 6 with the roller resistance difference R−R' satisfying the expression (1), with the thickness $d_1$ (mm) satisfying the expression (2) and with the roller resistance R of the overall developing roller 1 satisfying the expression (3), the solid black density and the dot density can be controlled at higher levels than the currently available levels.

This application corresponds to Japanese Patent Application No. 2014-232633 filed in the Japan Patent Office on Nov. 17, 2014, the disclosure of which is incorporated herein by reference in its entirety.

What is claimed is:

1. A developing roller comprising:

a tubular base layer of an elastic material; and a surface layer of an elastic material provided on an outer peripheral surface of the base layer;

wherein a thickness $d_1$ (mm) of the surface layer, a roller resistance R' (log Ω as measured with an application voltage of 10 V) of the base layer, and a roller resistance R (log Ω as measured with an application voltage of 100 V) of a stack including the base layer and the surface layer satisfy the following expressions (1) to (3):

$$1.0 \leq R - R' \quad (1)$$

$$0.1 \leq d_1 \leq 2 \quad (2)$$

$$7.5 \leq R \leq 8.5 \quad (3).$$

2. The developing roller according to claim 1, wherein the surface layer is formed from a rubber composition which comprises a rubber component including a diene rubber.

3. The developing roller according to claim 2, wherein the rubber component of the rubber composition for the surface layer includes at least one diene rubber selected from the group consisting of an acrylonitrile butadiene rubber and a chloroprene rubber, and an epichlorohydrin rubber.

4. The developing roller according to claim 1, wherein the base layer is formed from a rubber composition which comprises a rubber component, and not less than 30 parts by mass of carbon or graphite having an iodine adsorption amount of not less than 80 mg/g and an oil adsorption amount of not less than 60 ml/100 g, based on 100 parts by mass of the overall rubber component of the rubber composition for the base layer, wherein the roller resistance R' (log Ω as measured with an application voltage of 10 V) of the base layer satisfies the following expression (4):

$$R' \leq 7.0 \quad (4).$$

5. The developing roller according to claim 2, wherein the base layer is formed from a rubber composition which comprises a rubber component, and not less than 30 parts by mass of carbon or graphite having an iodine adsorption amount of not less than 80 mg/g and an oil adsorption amount of not less than 60 ml/100 g, based on 100 parts by mass of the overall rubber component of the rubber composition for the base layer, wherein the roller resistance R' (log Ω as measured with an application voltage of 10 V) of the base layer satisfies the following expression (4):

$$R' \leq 7.0 \quad (4).$$

6. The developing roller according to claim 3, wherein the base layer is formed from a rubber composition which comprises a rubber component, and not less than 30 parts by mass of carbon or graphite having an iodine adsorption amount of not less than 80 mg/g and an oil adsorption amount of not less than 60 ml/100 g, based on 100 parts by mass of the overall rubber component of the rubber composition for the base layer, wherein the roller resistance R' (log Ω as measured with an application voltage of 10 V) of the base layer satisfies the following expression (4):

$$R' \leq 7.0 \quad (4).$$

7. An image forming apparatus comprising the developing roller according to claim 1.

8. An image forming apparatus comprising the developing roller according to claim 2.

9. An image forming apparatus comprising the developing roller according to claim 3.

10. An image forming apparatus comprising the developing roller according to claim 4.

11. An image forming apparatus comprising the developing roller according to claim 5.

12. An image forming apparatus comprising the developing roller according to claim 6.

* * * * *